US010487442B2

(12) United States Patent
Han et al.

(10) Patent No.: US 10,487,442 B2
(45) Date of Patent: Nov. 26, 2019

(54) LAUNDRY MACHINE AND CONTROL METHOD THEREOF

(71) Applicant: LG ELECTRONICS INC., Seoul (KR)

(72) Inventors: Injae Han, Seoul (KR); Cheolsoo Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 294 days.

(21) Appl. No.: 14/770,650

(22) PCT Filed: Dec. 5, 2013

(86) PCT No.: PCT/KR2013/011184

§ 371 (c)(1),
(2) Date: Aug. 26, 2015

(87) PCT Pub. No.: WO2014/133247

PCT Pub. Date: Sep. 4, 2014

(65) Prior Publication Data

US 2016/0002843 A1 Jan. 7, 2016

(30) Foreign Application Priority Data

Feb. 28, 2013 (KR) ..... 10-2013-0022314

(51) Int. Cl.
*F26B 7/00* (2006.01)
*D06F 58/20* (2006.01)
(Continued)

(52) U.S. Cl.
CPC ..... *D06F 58/206* (2013.01); *D06F 58/24* (2013.01); *D06F 58/28* (2013.01); *D06F 25/00* (2013.01);
(Continued)

(58) Field of Classification Search
CPC ..... D06F 58/00; D06F 58/206; D06F 58/28; D06F 58/24; D06F 58/287; D06F 58/26;
(Continued)

(56) References Cited

U.S. PATENT DOCUMENTS

2010/0077787 A1 4/2010 Masuda et al.
2011/0098869 A1* 4/2011 Seo ..... G01D 4/004 700/296

(Continued)

FOREIGN PATENT DOCUMENTS

CN 1478946 3/2004
CN 1906451 1/2007

(Continued)

OTHER PUBLICATIONS

Chinese Office Action dated Nov. 30, 2016 issued in Application No. 201380073814.1 (with English Translation).

(Continued)

*Primary Examiner* — Jason Lau
(74) *Attorney, Agent, or Firm* — Ked & Associates LLP

(57) ABSTRACT

There are disclosed a laundry machine and a control method of a laundry machine including a heat pump module having an evaporator, a condenser and a compressor; and a blower for supplying the air heated by the heat pump module to a laundry accommodation unit, the control method including an initial operation step for operating the compressor at a first operation frequency; and a frequency decreasing step for decreasing the operation frequency of the compressor, when one or more of a compressed refrigerant temperature which is a temperature of refrigerant having passed the compressor and a condensed refrigerant temperature which is a temperature of a refrigerant having passed the condenser are a preset temperature of higher.

8 Claims, 7 Drawing Sheets

(51) Int. Cl.
*D06F 58/28* (2006.01)
*D06F 58/24* (2006.01)
*D06F 25/00* (2006.01)

(52) U.S. Cl.
CPC ..... *D06F 2058/287* (2013.01); *D06F 2058/2864* (2013.01); *D06F 2058/2896* (2013.01)

(58) Field of Classification Search
CPC ..... D06F 58/263; D06F 2058/287; D06F 2058/2864; D06F 2058/2896; D06F 59/00; D06F 33/00; D06F 33/08; D06F 23/004; D06F 23/005
USPC ..... 62/181, 183, 186, 305, 428, 507; 34/427
See application file for complete search history.

(56) References Cited

U.S. PATENT DOCUMENTS

2011/0178653 A1* 7/2011 Nawrot ..... D06F 58/206 700/300
2012/0186305 A1* 7/2012 Taniguchi ..... D06F 25/00 68/19
2015/0082658 A1* 3/2015 Contarini ..... D06F 58/206 34/524

FOREIGN PATENT DOCUMENTS

| | | | |
|---|---|---|---|
| CN | 101713141 | | 5/2010 |
| CN | 102105631 | | 6/2011 |
| DE | 102005041145 | | 3/2007 |
| EP | 2 333 141 | A1 | 6/2011 |
| JP | 2007-289558 | A | 11/2007 |
| JP | 2008-212662 | A | 9/2008 |
| JP | 2009-61163 | A | 3/2009 |

OTHER PUBLICATIONS

International Search Report issued in Application No. PCT/KR2013/011184 dated Mar. 31, 2014.
Chinese Office Action dated May 5, 2016 issued in Application No. 201380073814.1 (with English Translation).

* cited by examiner

[Fig. 1]
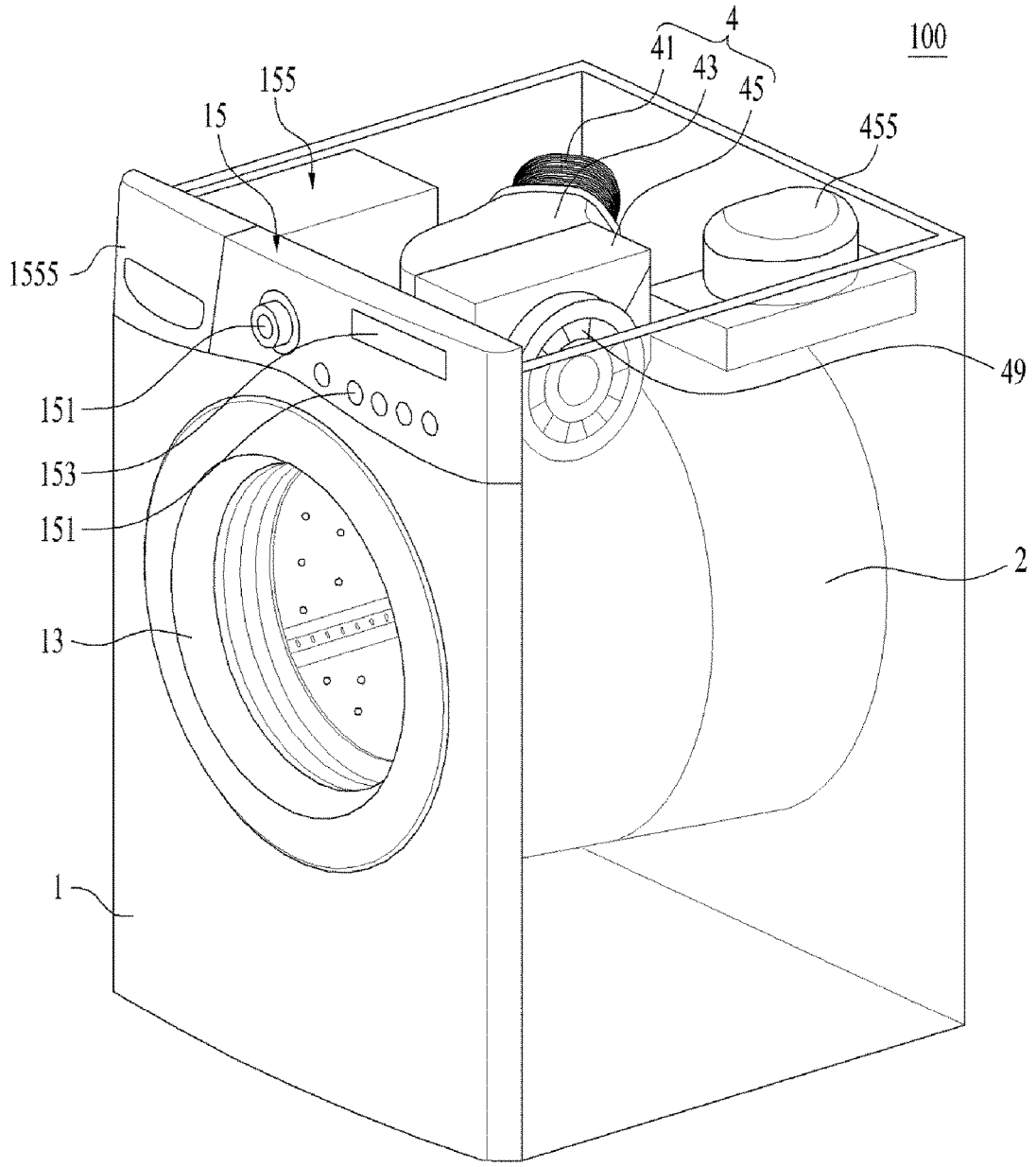

[Fig. 2]
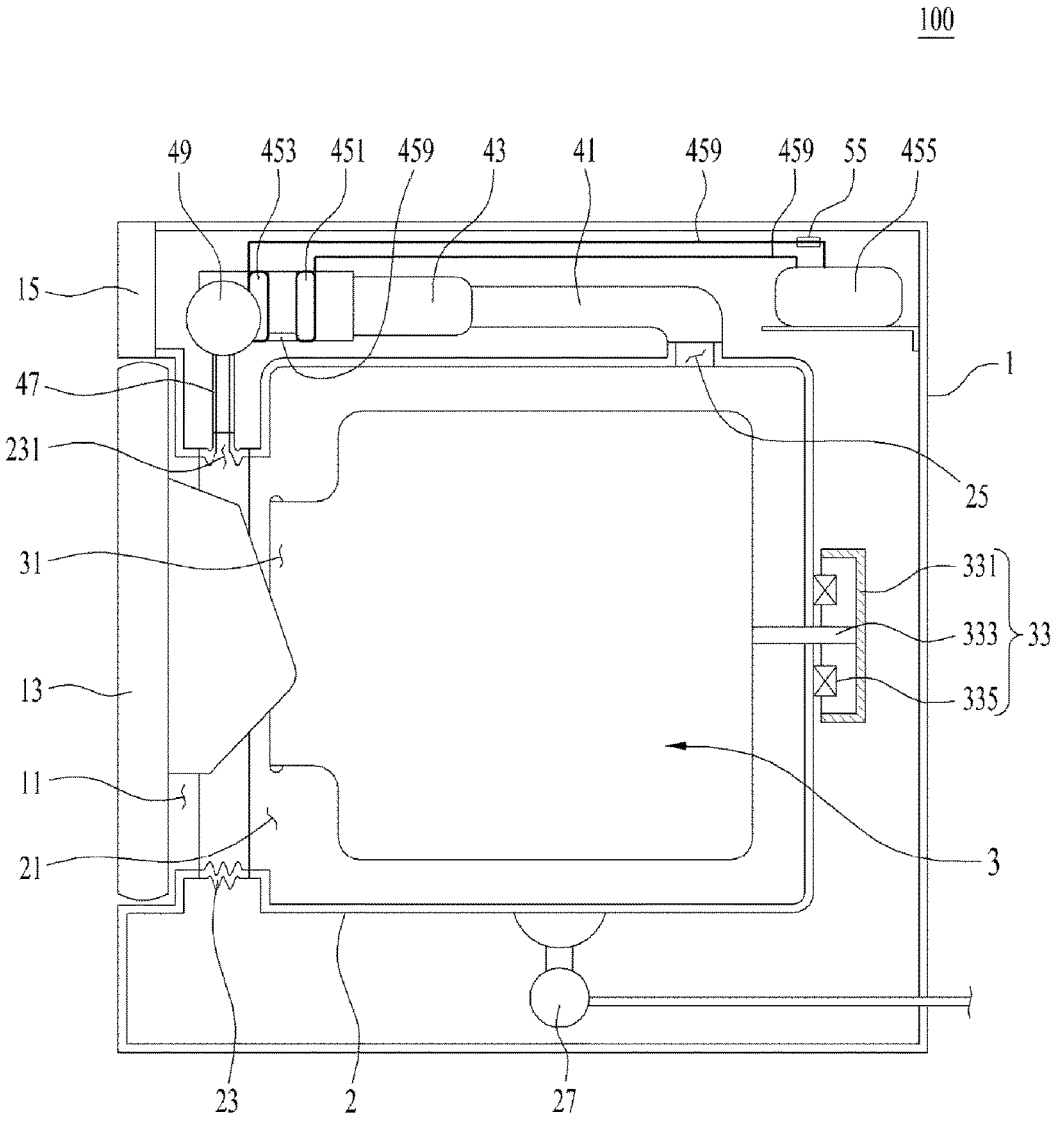

[Fig. 3]
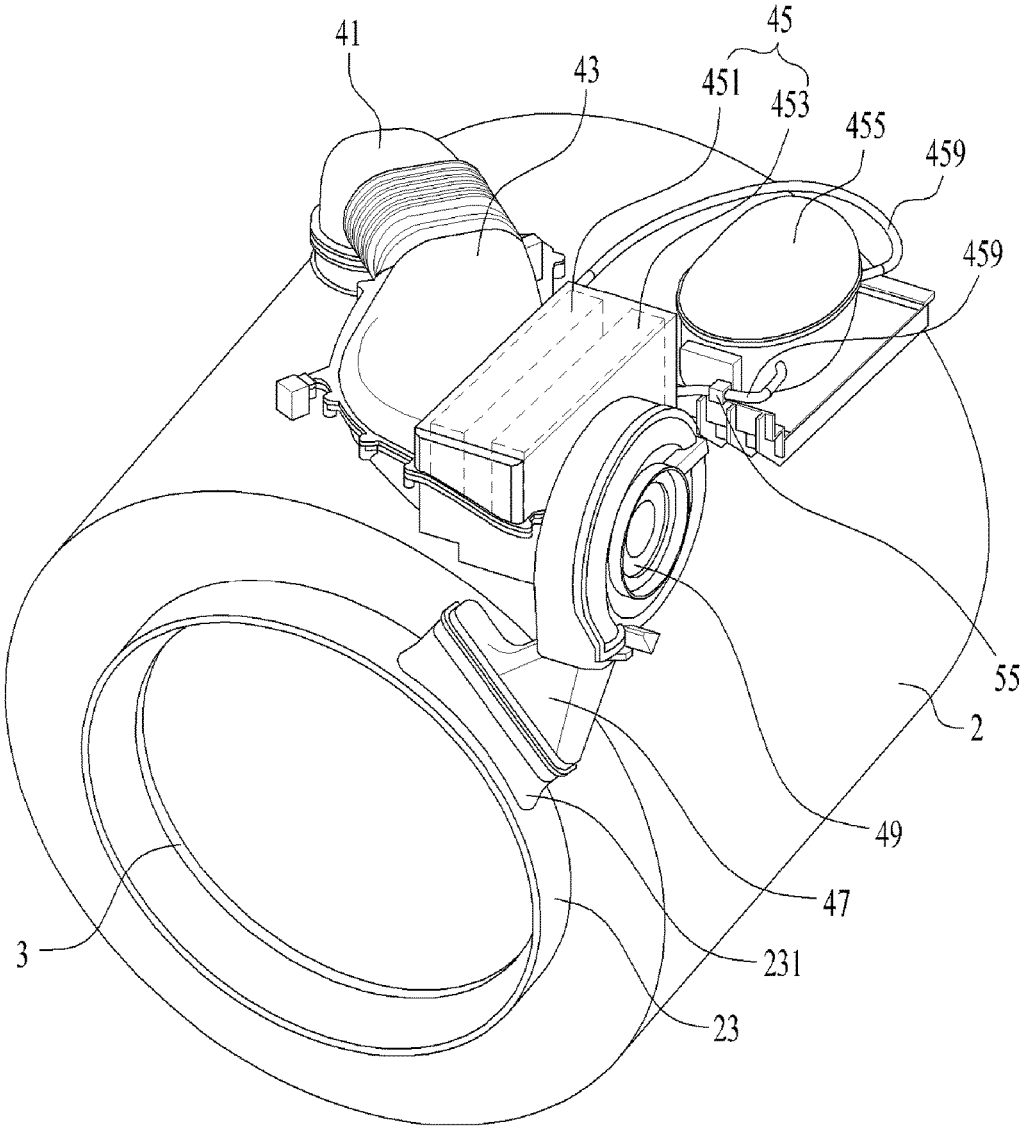

[Fig. 4]
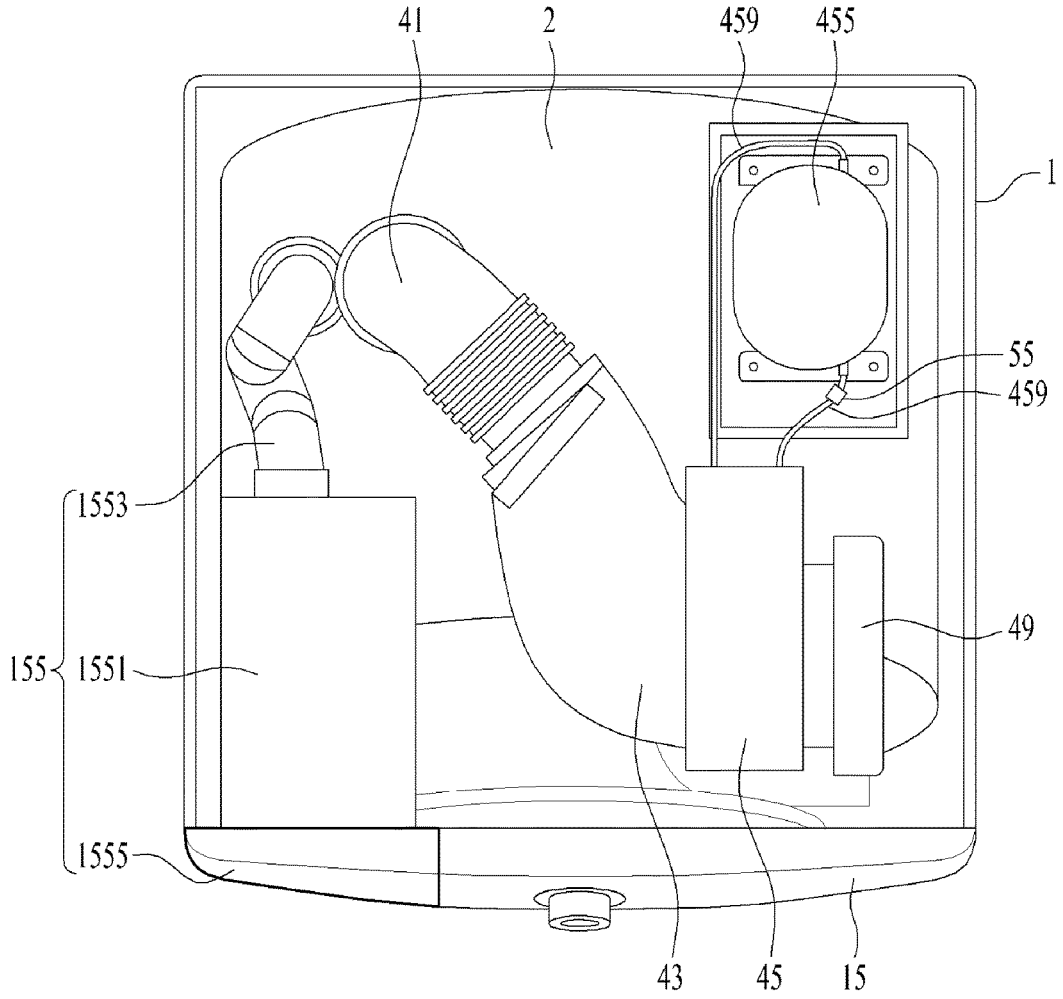

[Fig. 5]
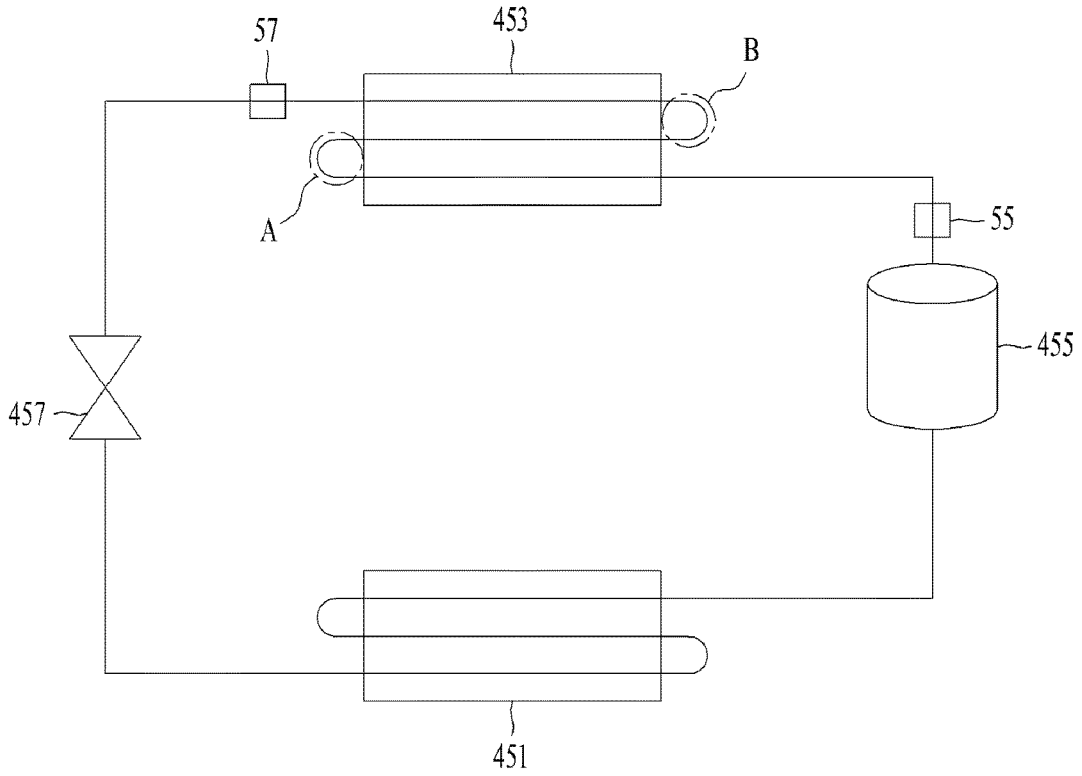

[Fig. 6]
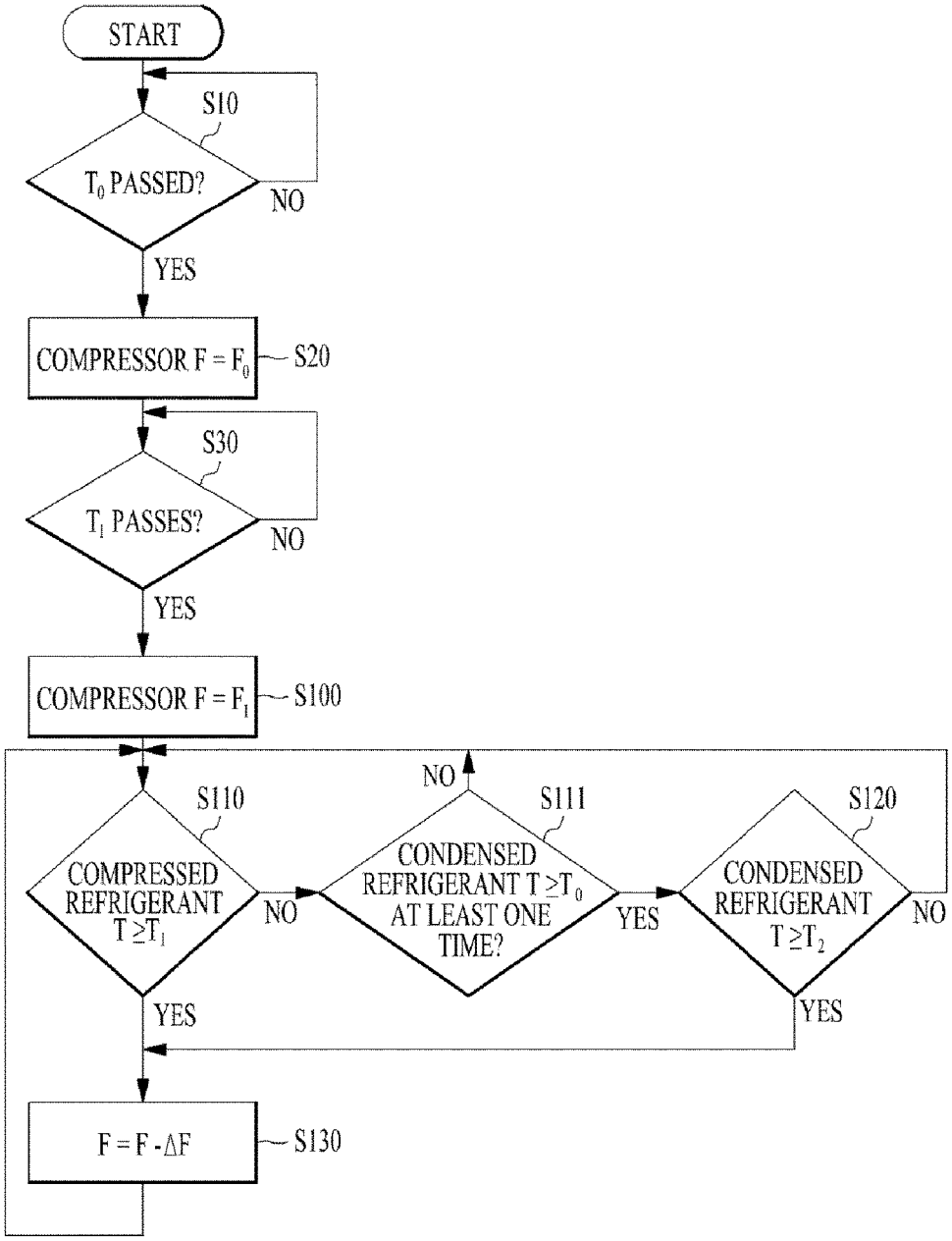

[Fig. 7]
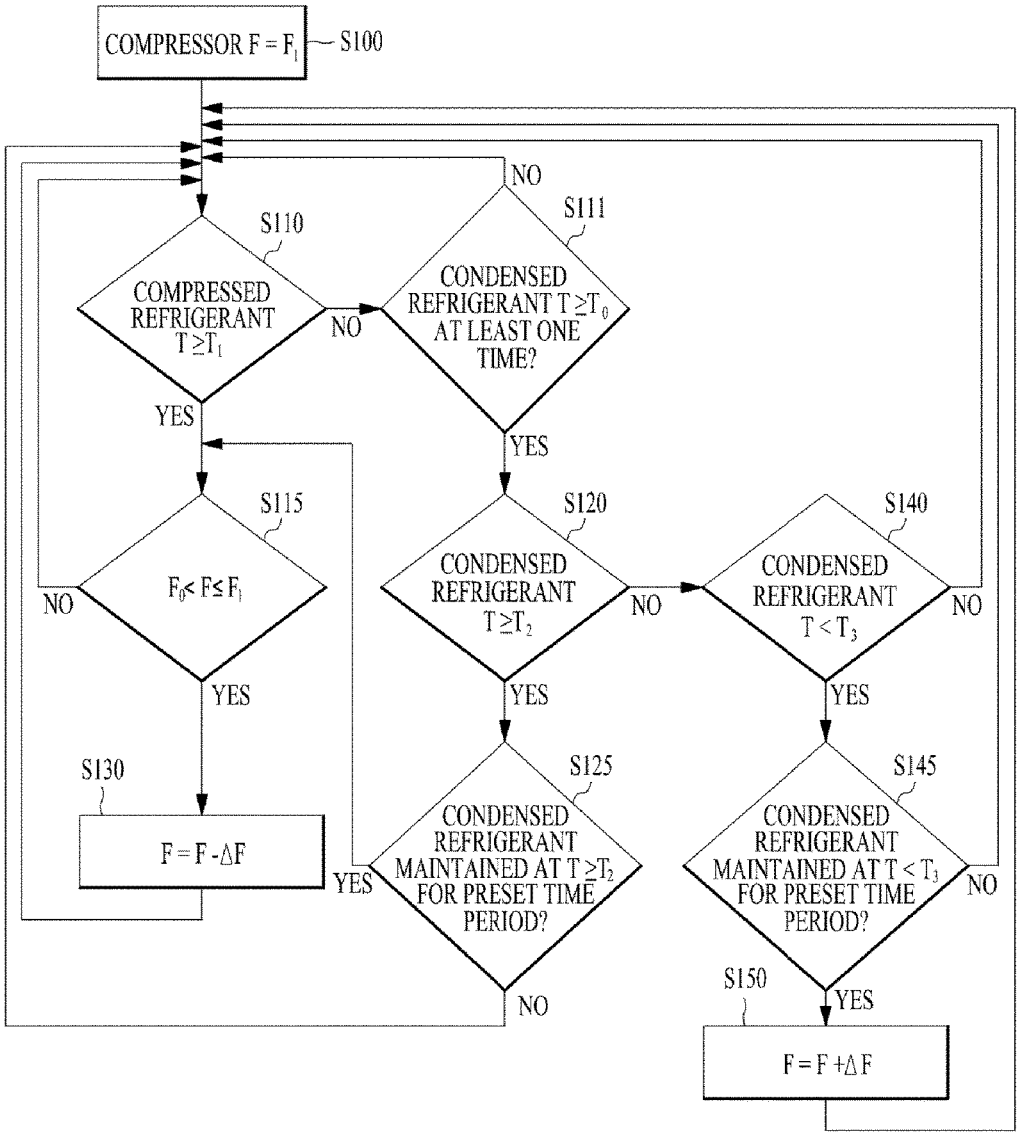

LAUNDRY MACHINE AND CONTROL METHOD THEREOF

CROSS-REFERENCE TO RELATED PATENT APPLICATIONS

This application is a U.S. National Stage Application under 35 U.S.C. § 371 of PCT Application No. PCT/KR2013/011184, filed Dec. 5, 2013, which claims priority to Korean Patent Application No. 10-2013-0022314, filed Feb. 28, 2013, whose entire disclosures are hereby incorporated by reference.

TECHNICAL FIELD

The present invention relates to a laundry machine and a control method thereof.

BACKGROUND ART

A laundry machine is an electric appliance used in washing, drying or both washing and drying and such a laundry machine conceptually include a washer, a dryer and a laundry machine for both washing and drying functions.

In a laundry machine capable of drying clothes, a high temperature air (hot air) is provided to clothes. The laundry machine may be categorized into an exhaustion type laundry machine and a circulation type (condensation type) laundry machine based on a method of air circulation.

In the structure of the circulation type laundry machine, air inside a laundry accommodation unit is circulated in the circulation type laundry machine and the moisture is removed (dehumidified) from the air exhausted from the laundry accommodation unit and the air without the moisture is heated, such that the heated air is re-provided to the laundry accommodation unit.

In the structure of the exhaustion type laundry machine, heated air is provided to a laundry accommodation unit and the air exhausted from the laundry accommodation unit is exhausted outside, not circulated.

A hot air supply unit provided in a conventional laundry machine includes a blower for exhausting air inside the laundry accommodation unit and a heat exchange unit for heating the air circulated by the blower. The heat exchange unit is configured of a heat pump module and the heat pump module includes a compressor.

Meanwhile, the noise generated by the conventional laundry machine is mostly generated by the noise of the driving compressor and the noise of the driving blower. When the operations of the compressor and the blower are set to the maximum to enhance drying efficiency, the drying efficiency can be enhanced and the operation noise can be increased. Accordingly, there may be a disadvantage of providing the user with unpleasant operation environment.

DISCLOSURE OF INVENTION

Technical Problem

Exemplary embodiments of the present disclosure provide a laundry machine having a high drying efficiency.

Solution to Problem

To achieve these objects and other advantages and in accordance with the purpose of the invention, as embodied and broadly described herein, a control method of a laundry machine including a heat pump module having an evaporator, a condenser and a compressor; and a blower for supplying the air heated by the heat pump module to a laundry accommodation unit, the control method includes an initial operation step for operating the compressor at a first operation frequency; and a frequency decreasing step for decreasing the operation frequency of the compressor, when one or more of a compressed refrigerant temperature which is a temperature of refrigerant having passed the compressor and a condensed refrigerant temperature which is a temperature of a refrigerant having passed the condenser are a preset temperature or higher.

The frequency decreasing step may include a step for decreasing the operation frequency of the compressor, when the compressed refrigerant temperature is a first preset temperature or higher.

The operation frequency of the compressor may be decreased when the compressed refrigerant temperature is the first preset temperature or higher and when the operation frequency of the compressor is between the first operation frequency and a second operation frequency lower than the first operation frequency.

The operation frequency of the compressor may be decreased, when the compressed refrigerant temperature is lower than a first preset temperature and when the condensed refrigerant temperature is a second preset temperature or higher.

An operation frequency of the compressor may be decreased, when the condensed refrigerant temperature is maintained at a second preset temperature or higher for a preset time period.

The control method of the laundry machine may further include a frequency increasing step for increasing the operation frequency of the compressor, when the compressed refrigerant temperature is lower than the first preset temperature and when the condensed refrigerant temperature is lower than the second preset temperature.

The frequency increasing step may be performed, when the operation frequency of the compressor is lower than a third operation frequency.

The frequency increasing step may be performed, when the condensed refrigerant temperature is maintained lower than the third preset temperature for a preset time period, the third preset temperature being lower than the second preset temperature.

A step for determining whether the condensed refrigerant temperature is the second preset temperature or higher after the condensed refrigerant temperature reaches a preset temperature at least one time is performed, when the compressed refrigerant temperature is lower than the first preset temperature.

The control method of the laundry machine may further include a step for increasing or decreasing the rotation frequency of the blower based on frequency change of the compressor.

The rotation frequency of the blower may be increased, when the frequency of the compressor is decreased.

In another aspect, a control method of a laundry machine including a heat pump module having an evaporator, a condenser and a compressor; and a blower for supplying the air heated by the heat pump module to a laundry accommodation unit, the control method includes an initial operation step for operating the compressor at a first operation frequency; and a frequency increasing step for increasing an operation frequency of the compressor, when a first condition in which a compressed refrigerant temperature as a temperature of refrigerant having passed the compressor is lower than a first preset temperature or a second condition in which a condensed refrigerant temperature as a temperature of refrigerant having passed the condenser is lower than a second preset temperature is satisfied.

The control method of the laundry machine may further include a frequency increasing step for increasing the operation frequency of the compressor, when both of the first condition and the second condition are satisfied.

The rotation frequency of the blower may be increased, when the operation frequency of the compressor is decreased.

A rotation frequency of the blower may be decreased, when the frequency increasing step is performed.

In a further aspect, a laundry machine includes a heat pump module comprising an evaporator, a condenser and a compressor; a blower for supplying the air heated by the heat pump module to a laundry accommodation unit; and a controller for increasing or decreasing an operation frequency of the compressor, wherein the compressor decreases the operation frequency of the compressor, when one or more of a compressed refrigerant temperature as a temperature of a refrigerant having passed the compressor and a condensed refrigerant temperature as a temperature of a refrigerant having passed the condenser are a preset temperature or higher.

The controller may decrease the operation frequency of the compressor, when the compressed refrigerant temperature is a first preset temperature or higher.

The controller may decreases the operation frequency of the compressor, when the compressed refrigerant temperature is a first preset temperature or higher and when the operation frequency of the compressor is between a first operation frequency of an initial operation frequency and a second operation frequency lower than the first operation frequency.

The controller may decrease the operation frequency of the compressor, when the compressed refrigerant temperature is lower than a first preset temperature and when the condensed refrigerant temperature is a second preset temperature or higher.

The controller may decrease the operation frequency of the compressor, when the condensed refrigerant temperature is maintained at the second preset temperature or higher for a preset time period.

Advantageous Effects of Invention

According to the embodiments of the present disclosure, the compressor may be driven efficiently in an initial operation stage of the laundry machine. In other words, the maximum efficiency of the compressor can be achieved from the initial operation stage of the laundry machine.

Furthermore, the rotation frequency of the blower may be increased as the frequency of the compressor is decreased. Accordingly, disadvantages of drying efficiency and noise generation can be overcome. Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF DRAWINGS

FIG. 1 is a perspective diagram of a laundry machine according to exemplary embodiments of the present disclosure;

FIG. 2 is a sectional diagram of the laundry machine;

FIGS. 3 and 4 are diagrams illustrating a structure of a heat pump module provided in the laundry machine;

FIG. 5 is a diagram schematically illustrating the heat pump module provided in the laundry machine; and FIGS. 6 and 7 are flow charts illustrating a control method of the laundry machine according to one embodiment of the present disclosure.

BEST MODE FOR CARRYING OUT THE INVENTION

Exemplary embodiments of the disclosed subject matter are described more fully hereinafter with reference to the accompanying drawings.

The disclosed subject matter may, however, be embodied in many different forms and should not be construed as limited to the exemplary embodiments set forth herein.

Exemplary embodiments of the disclosed subject matter are described herein with reference to cross-section illustrations that are schematic illustrations of idealized embodiments (and intermediate structures) of the disclosed subject matter. As such, variations from the shapes of the illustrations as a result, for example, of manufacturing techniques and/or tolerances, are to be expected. Thus, exemplary embodiments of the disclosed subject matter should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosed subject matter belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As shown in FIGS. 1 and 2, a laundry machine 100 according to exemplary embodiments of the present disclosure includes a cabinet 1 for defining an exterior appearance thereof, a laundry accommodation unit provided in the cabinet to accommodate laundry and a hot air supply unit 4 for supplying hot air to the laundry accommodation unit.

The cabinet includes a laundry introduction hole 11 for introducing laundry and a door 13 rotatably coupled to the cabinet 1 to open and close the laundry introduction hole 11.

Over the hole 11 may be provided a control panel 15 including one or more of an input unit 151 for inputting a control command for driving the laundry machine 100 and a display unit 153 for displaying a control history of the laundry machine.

The input unit 151 may be a rotary knob provided in the control panel 15 and a programs for washing or drying set in the laundry machine (e.g., a washing course and a drying course), a washing time, a quantity of wash water, a hot air supply time and other control commands may be input to a controller (not shown) via the input unit 151.

The display unit 153 displays the control command (e.g., the name of the course) input via the input unit and the information (e.g., a remaining time) generated by the driving laundry machine according to the input control command.

In case the laundry machine 100 according to the present disclosure is a laundry machine having both washing and drying functions, the laundry accommodation unit may include a tub provided in the cabinet to hold wash water and a drum 3 rotatably mounted in the tub to hold laundry.

Hereinafter, the laundry accommodation unit including both of the tub and the drum is described.

As shown in FIG. 2, the tub 2 is hollow-cylindrical-shaped and fixed in the cabinet 1. A tub hole 21 is provided in a front surface of the tub toward the laundry introduction hole 11 to introduce the laundry.

A gasket is provided between the tub hole 21 and the laundry introduction hole 23. The gasket 23 is means configured not only to prevent the wash water held in the tub from leaking outside but also to prevent the vibration generated from the tub during the rotation of the drum 3 from being transmitted to the cabinet 1. Accordingly, the gasket 23 may be formed of a vibration-insulation material (e.g., rubber).

The tub 2 may be provided in parallel with the ground supporting the cabinet 1 as shown in the drawing or tilted a preset angle from the ground. In case the tub 2 is tilted a preset angle from the ground, the tilted angle of the tub may be smaller than 90 degrees.

An air outlet hole 25 may be provided over a circumferential surface of the tub 2 to exhaust air from the tub 2 and a water drainage portion 27 may be provided under the tub to exhaust the wash water held in the tub.

The air outlet hole 25 may be provided along a longitudinal direction of the tub 2 and spaced apart a predetermined distance from a straight line passing a center of the tub 2 (see FIG. 3).

That structure is configured to exhaust the internal air of the tub 2 via the air outlet hole 25 smoothly while the drum is rotated and to suck foreign matters inside a hot air supply unit 4 via a foreign matter removing portion 6 into the tub toward a bottom surface of the tub 2 the tub 2 along an inner circumferential surface of the tub 2, such that the foreign matters can be prevented from being supplied to the drum 3.

The drum 3 is hollow-cylindrical-shaped and rotated within the tub 2 by a motor 33 provided outside the tub 2.

In this instance, the motor 33 may include a stator 335 fixed to a rear surface of the tub 2, a rotor 331 rotatable by electromagnetic interaction with the stator 335 and a shaft 333 connecting a rear surface of the drum 3 to the rotor 331, penetrating the rear surface of the tub 2.

A drum hole 31 is provided in the drum 3 to communicate with the laundry introduction hole 11 and the tub hole 21. A user may load laundry into the drum 3 via the laundry introduction hole 11 and unload the laundry held in the drum 3 out of the cabinet 1.

In case the laundry machine 100 is the laundry machine having the washing and drying functions, a detergent supply unit 155 may be further provided in the cabinet 1 to store the detergent which will be supplied to the tub 2.

The detergent supply unit 155 may include a storage portion (1551, see FIG. 4) provided as a drawer type retractable from the cabinet 1, a detergent supply pipe (1553, see FIG. 4) for guiding the detergent stored in the storage portion 1551 into the tub 2 and a storage handle 1555 provided adjacent to the control panel 15 for the user to pull out the storage portion 1551 from the cabinet 1.

The storage portion 1551 is provided with water from a water supply source (not shown) provided outside the laundry machine 100. When water is provided to the storage portion 1551 from the water supply source, the detergent stored in the storage portion 1551 may be provided to the tub 2 through the determined supply pipe 1553 together with the water.

The hot air supply unit 4 shown in FIG. 3 includes a circulation passage 41, 43 and 47 having one end for guiding the air exhausted from the tub 2 toward the front surface of the tub 2 (one surface of the tub formed toward the laundry introduction hole 11). The hot air supply unit 4 includes a heat pump module for heating the air circulating along the circulation passage 41, 43 and 47.

The heat pump module includes a heat exchanger 45 and a compressor 455 which are provided in the circulation passage. The hot air supply unit 4 includes a blower 49 for circulating internal air of the tub 2.

The circulation passage 41, 43 and 47 may allow the air exhausted from a rear portion of the tub 2 to move into the tub 3 via the front surface of the tub 2. FIG. 3 illustrates one embodiment of the circulation passage which exhausts the air into the tub 2 via an upper front circumferential surface portion of the tub 2.

Meanwhile, the circulation passage may include a suction duct 41 fixed to the air outlet hole 25 provided in the tub 2, a connection duct 43 connecting the suction duct 41 to the blower 49, with the heat exchanger 45 fixed therein, and an exhaustion duct 47 connecting the blower 49 and the gasket 23 with each other.

The suction duct 41 may be a passage allowing the internal air of the tub exhausted via the air outlet hole 25 formed behind a circumferential surface of the tub and it may be formed of a vibration-insulation material (e.g., rubber)

That is to prevent the vibration generated in the tub 2 by the rotating drum 3 from being transmitted to the connection duct 43 and the heat exchanger 45 via the suction duct 41.

To shut the vibration generated in the tub 2 from being transmitted to the connection duct 43 and the heat exchanger 45 more efficiently, bellows may be further provided in the suction duct 41. Such bellows may be provided in entire portions of the suction duct 41 or a predetermined portion (e.g., a connected portion of the connection duct) of the suction duct 41.

The heat exchanger 45 may include an evaporator 451 and a condenser 453. The evaporator 451 and the condenser 453 may be fixed in the connection duct 43. Alternatively, the compressor 455 may be provided in an outer portion of the connection duct 43.

The compressor 455 may be connected to the evaporator 451 and the condenser 453 via a refrigerant pipe 459 such that refrigerant can be circulated between two of the evaporator 451, the condenser 453 and the compressor 455 by the compressor 455.

In the evaporator 451, the refrigerant sucks heat from the air sucked into the connection duct 43. The evaporator 451 may be means for chilling air and eliminating the moisture from the air (dehumidifying the air).

As mentioned above, the air inside the connection duct 43 is chilled while passing through the evaporator 451 and condensate remains in the connection duct 43.

When the condensate remains in the connection duct 43, the condensate may be supplied to the laundry which is being dried and means for exhausting the remaining condensate outside the connection duct 43 may be further provided.

The means for exhausting the condensate outside the connection duct 43 may be various types and examples of the various types may include a passage (not shown) connecting the connection duct 43 to the water drainage unit 27.

The refrigerant is condensed in the condenser 453 and the heat generated in the condensation process of the refrigerant is transmitted to the air passing through the condenser 453, such that the condenser 453 may be the means for heating the air having passed the evaporator 451.

The circulation passage 41, 43 and 47 shown in FIG. 3 may be provided in a diagonal direction with respect to a top surface of the tub 2. In this instance, the compressor 455 may be arranged in a predetermined space formed between the circulation passage and the cabinet over the tub 2. That is configured to utilize the space formed over the outer circumferential surface of the tub 2 so as to prevent the height and volume of the laundry machine from increasing.

The exhaustion duct 47 may be the means for guiding the air exhausted from the connection duct 43 by the blower 49 into the tub 2. One end of the exhaustion duct 47 is fixed to the blower 49 and the other end thereof is connected to the duct connection hole 231 provided in the gasket 23.

One or more of the gasket 23 and the exhaustion duct 47 may be formed of a vibration-insulation material (or a flexible material) to prevent the vibration generated in the tub by the rotating drum 3 from being transmitted to the blower 49 or the connection duct 43.

The blower 49 is provided between the heat exchanger 45. Accordingly, the blower 49 generates a negative pressure behind the heat exchanger 45 to make the air pass through the heat exchanger 45, not a positive pressure in front of the heat exchanger 45.

Meanwhile, the laundry machine may further include a first temperature sensor 55 for measuring a temperature of the refrigerant exhausted from the compressor 455. The laundry machine may further include a second temperature sensor 57 for measuring a temperature of the refrigerant passing through or exhausted from the condenser 453.

The first temperature sensor 55 measures the temperature of the refrigerant having passed through the compressor (hereinafter, "the compressed refrigerant temperature"). The first temperature sensor 55 is installed in a refrigerant pipe 459 provided between the compressor 455 and the condenser 453 and measures the compressed refrigerant temperature. At this time, the first temperature sensor 55 is installed adjacent to the compressor 455. In other words, the first temperature sensor 55 may be installed in the refrigerant pipe 459 provided between the compressor 455 and the condenser 453, more adjacent to the compressor 455.

The second temperature sensor 57 measures the temperature of the refrigerant passing through (or having passed) the condenser 453 (hereinafter, "the condensed refrigerant temperature"). Referring to FIG. 5, the second temperature sensor 57 is installed in a refrigerant pipe 459 provided between the condenser 453 and an expansion valve 457 and measures the condensed refrigerant temperature. At this time, the first temperature sensor 55 is installed adjacent to the compressor 455. In other words, the first temperature sensor 55 may be installed in the refrigerant pipe 459 provided between the compressor 455 and the condenser 453, preferably, more adjacent to the compressor 455. Meanwhile, the second temperature sensor 57 may be installed in the refrigerant pipe 459 provided between the condenser 453 and the expansion valve 457 to measure the temperature of the refrigerant exhausted after passing through the condenser 453 completely. However, the position of the second temperature sensor 57 is not limited thereto. Typically, the refrigerant pipe is bent several times, when passing through the condenser 453, to enhance heat exchange efficiency. At this time, the second temperature sensor 57 may be provided in bent portions (A) and (B) of the refrigerant pipe 459 toward the condenser 453 after having passed the condenser 453.

Hereinafter, a control method of the laundry machine according to one embodiment of the present disclosure will be described. The control method which will be described as follows may be performed by the controller provided in the laundry machine. In other words, control for changing a frequency of the compressor 455 and control for changing a rotation frequency of the blower 49 may be performed by the controller.

Referring to FIG. 6, the control method of the laundry machine according to this embodiment of the present disclosure may include an initial operation step (S100) for operating an operation frequency of the compressor at a first frequency. A frequency reduction step (S130) for decreasing an operation frequency of the compressor may be further provided, when one or more of the compressed refrigerant temperature which is the temperature of the refrigerant having passed the compressor 455 and the condensed refrigerant temperature which is the temperature of the refrigerant having passed the condenser 453 is a preset temperature or higher.

The initial operation step (S100) is performed in an initial operation stage of the laundry machine. When the user operates the laundry machine initially, the controller sets the operation frequency of the compressor 455 as the preset first frequency. At this time, the first frequency may be 68 Hz.

A preheating step (S20) for preheating the compressor may be further performed before the initial operation step (S100). The preheating step (S20) is the step in which the compressor is driven at a preheating frequency for a preset time period ($t_1$).

The preheating step (S20) may include a step of driving the compressor 455, with setting the compressor at the preheating frequency in a preset time period ($t_0$) after the driving of the laundry machine starts. At this time, the control system of the laundry machine may be loaded during the preset time period ($t_0$). The preset time period may be 30 seconds. The preset time period ($t_0$) passes and the compressor 455 is then driven at the preheating frequency. After that, the preset time period ($t_1$) passes and the compressor 455 is then driven at the first frequency of the initial operation step (S100). In other words, after the compressor is driven at the preheating frequency for the preset time period ($t_1$), the initial operation step (S100) is performed.

A plurality of preheating steps (S20) may be performed and the preheating frequency of each preheating step (S20) may be set differently. It is preferred that the preheating frequency of the next preheating step performed after one preheating step is set higher than the preheating frequency of the preheating step.

For example, when the preheating step is performed two times, the preheating frequency of the preheating step performed firstly may be set as 36 Hz and the preheating frequency of the preheating step performed later may be set as 58 Hz.

The order of the process in which the preheating step is performed two times will be described in detail. Once the preset time period (t0, e.g., 30 seconds) passes after the laundry machine is put into operation initially, a first preheating step for the compressor is performed in which the compressor is driven at the first preheating frequency. The first preheating frequency may be 36 Hz. A second preheating step is performed in a preset time period ($t_1$) after the compressor is driven at the first preheating frequency for the preset time period ($t_1$). The second preheating step sets a second preheating frequency for the compressor and drives the compressor at the second preheating frequency for a preset time period ($t_2$). At this time, the second preheating frequency may be higher than the first preheating frequency. In one embodiment, the second preheating frequency may be 58 Hz. The initial operation step is performed in a preset time period ($t_2$) after the compressor is driven at the second preheating frequency. The time period ($t_1$) for which the first preheating step is performed may be same as the time period for which the second preheating step is performed. In one embodiment, the time period may be 2 minutes.

After the initial operation step (S100) mentioned above is performed, the frequency decreasing step (S130) is performed. The frequency decreasing step (S130) decreases the operation frequency of the compressor, when one or more of the compressed refrigerant temperature and the condensed refrigerant temperature are a preset temperature or higher. The frequency decreasing step (S130) may be performed when the compressed refrigerant temperature is a preset temperature or higher or when the condensed refrigerant temperature is a preset temperature or higher. Alternatively, the frequency decreasing step (S130) may be performed when both the compressed refrigerant temperature and the condensed refrigerant temperature are the preset temperature or higher.

In one embodiment of the present disclosure, a step of determining whether the compressed refrigerant temperature is a first preset temperature ($T_1$) or higher may be performed before the frequency decreasing step (S130). When the compressed refrigerant temperature is the first preset temperature or higher, the frequency decreasing step (S130) for decreasing the operation frequency of the compressor 455 is performed. The first preset temperature ($T_1$) may be 105° C. It is determined whether the compressed refrigerant temperature which is the temperature of the refrigerant exhausted from the compressor is the first preset temperature or higher. When the compressed refrigerant temperature is the first preset temperature ($T_1$) or higher, the operation frequency of the compressor 455 is decreased as low as a preset frequency ($\Delta F$). The decreased frequency value may be 1 Hz or 2 Hz and it is not limited thereto. The compressed refrigerant temperature is measured by the first temperature sensor 55.

When the operation frequency of the compressor 455 is decreased based on the result of the determination that the compressed refrigerant temperature is the first preset temperature ($T_1$) or higher, the compressor 455 is driven at the decreased frequency and the step (S110) for determining whether the compressed refrigerant temperature is the first preset temperature ($T_1$) or higher may be repeated.

When the compressed refrigerant temperature is less than the first preset temperature ($T_1$) or lower, a step (S120) for determining whether the condensed refrigerant temperature is a second preset temperature ($T_2$) or higher is performed.

When the condensed refrigerant temperature is the second preset temperature ($T_2$) or higher, the frequency decreasing step (S130) for decreasing the operation frequency of the compressor 455 as much as a preset frequency ($\Delta F$) is performed. In contrast, when the condensed refrigerant temperature is lower than the second preset temperature, the step for determining whether the compressed refrigerant temperature is the first preset temperature ($T_1$) or higher (S110) is performed.

Accordingly, when the compressed refrigerant temperature is the first preset temperature ($T_1$) or higher or when the condensed refrigerant temperature is the second preset temperature ($T_2$) or higher, with the compressed refrigerant temperature lower than the first preset temperature ($T_1$), the operation frequency of the compressor is decreased. The second preset temperature ($T_2$) may be the first preset temperature ($T_1$) or lower. In one embodiment, the second preset temperature may be in a range of 75 to 80 degrees, preferably, 75 degrees.

In contrast, when the compressed refrigerant temperature is lower than the first preset temperature ($T_1$) and the condensed refrigerant temperature is lower than the second preset temperature ($T_2$), the operation frequency of the compressor is not changed and the step for determining whether the compressed refrigerant temperature is the first preset temperature or higher (S110) is performed.

Meanwhile, the step for determining whether the condensed refrigerant temperature is the second preset temperature ($T_2$) or higher may be performed after the condensed refrigerant temperature reaches a preset temperature ($T_0$) at least one time. In other words, when the compressed refrigerant temperature is lower than the first preset temperature ($T_1$), a step for determining whether the condensed refrigerant temperature reaches the preset temperature ($T_0$) at least one time (S111) is performed. When the condensed refrigerant temperature reaches the preset temperature ($T_0$) at least one time, the step for determining whether the condensed refrigerant temperature is the second preset temperature ($T_2$) or higher (S120) is performed. Unless the condensed refrigerant temperature reaches the preset temperature ($T_0$) at least one time, it returns to the step for determining whether the compressed refrigerant temperature is the first preset temperature ($T_1$) or higher (S110). It is designed by determining whether the condensed refrigerant temperature reaches the preset temperature ($T_0$) at least one time that a step for decreasing the frequency of the compressor after the compressor is preheated for a preset time period (S130) is performed. The preset temperature may be the second preset temperature ($T_2$) or higher. It means that the condensed refrigerant temperature reaches the preset temperature at least one time. Accordingly, even when the condensed refrigerant temperature is in a range of temperatures lower than the preset temperature by the frequency decreasing step (S130) for decreasing the frequency of the compressor, the step for determining whether the condensed refrigerant temperature is the second preset temperature ($T_2$) or higher is performed. In other words, the condition allowing the condensed refrigerant temperature to reach the preset temperature ($T_0$) at least one time is corresponding to an initial performance condition for performing the step for determining whether the condensed refrigerant temperature is the second preset temperature ($T_2$) or higher (S120). Accordingly, after the condensed refrigerant temperature reaches the preset temperature ($T_0$) at least one time, whether the condensed refrigerant temperature reaches the preset temperature may not affect whether the condensed refrigerant temperature is the second preset temperature ($T_2$) or higher.

The frequency decreasing step (S130) performed after the initial operation step (S100) will be described again. When the compressed refrigerant temperature is the first preset temperature ($T_1$) or higher, the frequency decreasing step for decreasing the frequency of the compressor (S130) is performed. Also, when the compressed refrigerant temperature is lower than the first preset temperature, the step for determining whether the condensed refrigerant temperature is the second preset temperature ($T_2$) or higher (S120) is performed. At this time, the step for determining whether the condensed refrigerant temperature is the second preset temperature ($T_2$) or higher (S120) is performed when the condensed refrigerant temperature reaches the preset temperature ($T_0$) at least one time (S111). When the compressed refrigerant temperature is lower than the first preset temperature ($T_1$) and when the condensed refrigerant temperature is the second preset temperature ($T_2$) or higher, the frequency decreasing step for decreasing the frequency of the compressor (S130) is performed. When the condensed refrigerant temperature is lower than the second preset temperature ($T_2$), the frequency of the compressor is not changed and it returns to the step for determining whether the compressed refrigerant temperature is the first preset temperature ($T_1$) or higher (S110).

Referring to FIG. 7, the embodiment of the present disclosure will be described in detail. The same numeral references are corresponding to the same steps and repeated description is omitted.

Referring to FIG. 7, when a compressed refrigerant temperature is a first preset temperature or higher (S110), a step for determining what is a range of compressor frequencies (S115) is performed. Even when the compressed refrigerant temperature is the first preset temperature or higher, it is determined whether the frequency of the compressor is in a range of a first frequency ($F_1$) to a second frequency ($F_0$) (S115). When the frequency of the compressor is in the range of the first frequency to the second frequency, the frequency of the compressor is decreased (S130).

When the frequency of the compressor is out of the range of the first frequency to the second frequency, the frequency of the compressor is not changed and it returns to the step for determining whether the compressed refrigerant temperature is the first preset temperature or higher (S110).

The first frequency ($F_1$) has a value higher than the second frequency (F0). The second frequency (F0) may be 36 Hz.

The step for determining whether the frequency of the compressor 455 is in the range of the first frequency to the second frequency (S115) may be replaced with a step of determining the lower limit of the frequency of the compressor. In other words, even when the step for decreasing the frequency of the compressor in case the compressed refrigerant temperature is the first preset temperature or higher, the frequency of the compressor is not decreased by the second frequency or lower which is the lower limit of the frequency of the compressor. The value of the frequency gained after decreasing a preset frequency (ΔF) from the current frequency of the driving compressor is the second frequency or lower which is the lower limit of the frequency, the frequency need not be decreased. The setting of the lower limit of the frequency may be performed in the step for decreasing the frequency of the compressor 455 performed when the condensed refrigerant temperature is the second preset temperature or higher. Specifically, in case of decreasing the frequency of the compressor as the condensed refrigerant temperature is corresponding to the second preset temperature or higher, the value of the frequency changed by the decreasing is corresponding to the second frequency or lower which is the lower limit of the frequency and then the frequency is not decreased.

The step for determining whether the condensed refrigerant temperature reaches the preset temperature ($T_0$) at least one time, in case the compressed refrigerant temperature is lower than the first preset temperature (S111) is performed. This step (S111) is the same as the step described in reference to FIG. 6 and repeated description is omitted.

In this embodiment, when the condensed refrigerant temperature is the second preset temperature or higher, a step for determining whether the condensed refrigerant temperature is maintained at the second preset temperature or higher (S125) may be further performed. In case the condensed refrigerant temperature is maintained at the second preset temperature or higher for a predetermined time period in the determining step (S125), the step for decreasing the frequency of the compressor (S130) is performed. if the condensed refrigerant temperature is not maintained at the second preset temperature or higher for a predetermined time period, it returns to the step for determining whether the compressed refrigerant temperature is maintained at the first preset temperature or higher (S110), not changing the frequency of the compressor. The predetermined time period in the determining step (S125) may be set differently according to a control environment. For example, the time period may be 30 seconds. In case of decreasing the frequency in the determining step (S125), the step for determining whether the frequency range is in the range of the first frequency to the second frequency (S115) is performed and the step for decreasing the frequency of the compressor (S130) is performed. In other words, the lower limit of the frequency may be set as the second frequency ($F_0$), even in case of decreasing the frequency in the determining step (S125).

In case the condensed refrigerant temperature is lower than the second preset temperature ($T_2$), a step for increasing the frequency of the compressor by a preset frequency value (ΔF) (S150) may be performed. The increased frequency value (ΔF) may be 1 Hz or 2 Hz and the value is not limited thereto. When the condensed refrigerant temperature is lower than the second preset temperature ($T_2$), the step for increasing the frequency of the compressor (S150) may be performed immediately and it is preferred that the step for increasing the frequency of the compressor (S150) when the condensed refrigerant temperature is lower than a third preset temperature ($T_3$) is performed. In other words, a step for determining whether the condensed refrigerant temperature is lower than the third preset temperature ($T_3$) (S145) may be performed when the condensed refrigerant temperature is lower than the second temperature ($T_2$). Based on the result of the determining step (S145), the step for increasing the frequency of the compressor by the preset frequency (ΔF) in case the condensed refrigerant temperature is lower than the third preset temperature ($T_3$). When the condensed refrigerant temperature is the third preset temperature ($T_3$) or higher, the frequency of the compressor is not changed. At this time, it may return to the step for determining whether the compressed refrigerant temperature is the first preset temperature or higher, without changing the frequency of the compressor.

The upper limit of the frequency may be set in the frequency increasing step (S150). In other words, even when the frequency of the compressor is increased by the frequency increasing step (S150) in case the condensed refrigerant temperature is lower than the third preset temperature, the frequency may be set not increased to the upper limit of the frequency or higher. The frequency increasing step (S150) may be performed in case the current frequency of the driving compressor is lower than the upper limit of the frequency. When the frequency increased from the current frequency of the driving compressor by the predetermined frequency (ΔF) is higher than the upper limit of the frequency, the frequency of the compressor may not be increased. Hence, it may return to the step (S110) for determining whether the compressed refrigerant temperature is the first preset temperature or higher, without changing the frequency of the compressor. In one embodiment, the third preset temperature ($T_3$) may be 74 degrees. The upper limit of the frequency may be the same as the first frequency ($F_1$) set in the initial operation step (S100).

The control performed in the range of the condensed refrigerant temperatures, in case the compressed refrigerant temperature is lower than the first preset temperature, will be described again. The frequency decreasing step (S130) for decreasing the frequency of the compressor when the condensed refrigerant temperature is the second preset temperature or higher is performed. When the condensed refrigerant temperature is between the third preset temperature and the second preset temperature, the frequency is not changed. When the condensed refrigerant temperature is lower than the third preset temperature, the frequency increasing step (S150) is performed. As mentioned above, in case of performing the frequency decreasing step (S130) or the frequency increasing step (S150), it is determined whether the condensed refrigerant temperature is maintained at the second preset temperature or higher for a preset time period (S125) or maintained lower than the third preset temperature (S145).

In case the condensed refrigerant temperature is lower than the third preset temperature, a step for determining whether the condensed refrigerant temperature is maintained lower than the third preset temperature for the preset time period (S145) may be further performed. When the condensed refrigerant temperature is maintained lower than the third preset temperature for the preset time period, the frequency of the compressor is increased by a preset frequency (ΔF)(S150). When the condensed refrigerant temperature is not maintained lower than the third preset temperature, the frequency of the compressor is not changed. At this time, it may return to the step for determining whether the compressed refrigerant temperature is the first preset temperature or higher (S110), without changing the frequency of the compressor.

According to the embodiment of the present disclosure, there may be further provided a step for changing a rotation frequency of the blower 49 according to the change in the frequency of the compressor 455.

Referring to FIG. 7, in case of changing the frequency of the compressor according to the compressed refrigerant temperature and/or the condensed refrigerant temperature, the rotation frequency of the blower 49 may be changed in connection with the frequency change of the compressor 455 (S130 and S150).

At this time, the frequency change of the compressor 455 may be in reverse proportion to the rotation frequency change of the blower 49. When the frequency of the compressor 455 is decreased in step S130, the rotation frequency of the blower 49 is increased in step S130. When the frequency of the compressor may be is increased in step S150, the rotation frequency of the blower 49 may be decreased in step S150.

A variation amount of the rotation frequency of the blower 49 corresponding to 1 Hz frequency of the compressor 455 may be changeable according to the control environment. In one embodiment, the variation amount of the rotation frequency of the blower 49 corresponding to 1 Hz frequency variation of the compressor 455 may be 20 rpm. Accordingly, when increasing the frequency of the compressor 455 by 10 Hz, the rotation frequency of the blower 49 may be decreased by 200 rpm. When decreasing the frequency of the compressor 455 by 10 Hz, the rotation frequency of the blower 49 may increase by 200 rpm. Before the rotation frequency of the blower 49 is changed, an initially set rotation frequency may be 4200 rpm.

As mentioned above, the frequency increasing step or the frequency decreasing step may be performed based on the compressed refrigerant temperature and/or the condensed refrigerant temperature are performed, such that the compressor may be driven efficiently in the initial operation stage of the laundry machine. In other words, there may be the effect that the maximum efficiency of the compressor can be achieved from the initial operation stage of the laundry machine.

Furthermore, the noise generated in the laundry machine is mostly generated by the noise generated by the driving compressor and the noise generated by the driving blower. When the operations of the compressor and the blower are set to the maximum to enhance drying efficiency, the operation noise could be increased and unpleasant operation environment may be provided to the user. In the present disclosure, the laundry machine may maintain the efficiency of the compressor to the maximum in the initial stage of the drying and the frequency of the compressor is gradually decreasing as the time passes. As the frequency of the compressor is decreased, the rotation frequency of the blower is increased and the disadvantages of the lower drying efficiency and noise generation may be overcome simultaneously.

Various variations and modifications of the refrigerator described above are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A control method of a laundry machine comprising a heat pump module having an evaporator, a condenser and a compressor; and a blower that supplies the air heated by the heat pump module to a laundry accommodation unit, the control method comprising:

an initial operation step for maintaining operation of the compressor at a first operation frequency; and a frequency decreasing step for decreasing the operation frequency of the compressor, when a refrigerant temperature of refrigerant that passes the compressor and the condenser is a first preset temperature or higher, a frequency increasing step for increasing the operation frequency of the compressor, when the refrigerant temperature is lower than the first preset temperature and when the refrigerant temperature is lower than a second preset temperature, wherein when the refrigerant temperature is lower than the first preset temperature and the refrigerant temperature is maintained at or above the second preset temperature for a preset time period, the operating frequency of the compressor is maintained during the preset time period and then decreased at the end of the preset time period, wherein the frequency increasing step is performed, when the operation frequency of the compressor is lower than a third operation frequency, wherein the frequency increasing step is performed after the refrigerant temperature has been maintained lower than a third preset temperature for a preset time period, the third preset temperature being lower than the second preset temperature.

2. The control method of the laundry machine according to claim 1, wherein the operation frequency of the compressor is decreased when the operation frequency of the compressor is between the first operation frequency and a second operation frequency lower than the first operation frequency.

3. The control method of the laundry machine according to claim 1, wherein a step for determining whether the refrigerant temperature is the second preset temperature or higher is performed after the refrigerant temperature reaches a preset threshold temperature at least one time and when the compressed refrigerant temperature is lower than the first preset temperature.

4. The control method of the laundry machine according to claim 1, further comprising:

a step for increasing or decreasing the rotation frequency of the blower based on frequency change of the compressor.

5. The control method of the laundry machine according to claim 4, wherein the rotation frequency of the blower is increased, when the frequency of the compressor is decreased.

6. A control method of a laundry machine comprising a heat pump module having an evaporator, a condenser and a compressor; and a blower that supplies the air heated by the heat pump module to a laundry accommodation unit, the control method comprising:

an initial operation step for operating the compressor at a first operation frequency; and a frequency decreasing step for decreasing the operation frequency of the compressor, when one or more of a compressed refrigerant temperature which is a temperature of refrigerant having passed the compressor and a condensed refrigerant temperature which is a temperature of a refrigerant having passed the condenser are a preset temperature or higher, wherein the rotation frequency of the blower is increased when the frequency of the compressor is decreased.

7. The control method of the laundry machine according to claim 6, wherein a rotation frequency of the blower is decreased, when the frequency increasing step is performed.

8. A laundry machine comprising:

a heat pump module comprising an evaporator, a condenser and a compressor;

a blower that supplies the air heated by the heat pump module to a laundry accommodation unit; and a controller that increases or decreases an operation frequency of the compressor, wherein the compressor decreases the operation frequency of the compressor, when one or more of a compressed refrigerant temperature which is a temperature of a refrigerant having passed the compressor and a condensed refrigerant temperature which is a temperature of a refrigerant having passed the condenser are a first preset temperature or higher, wherein when the compressed refrigerant temperature is lower than the first preset temperature and the condensed refrigerant temperature is maintained at or above a second preset temperature for the preset time period after the condensed refrigerant temperature reaches a preset temperature at least one time, the operating frequency of the compressor is maintained during the preset time period and then decreased at the end of the preset time period, wherein when the refrigerant temperature is lower than the first preset temperature and when the refrigerant temperature is lower than the second preset temperature, the controller is provided to increase the operation frequency of the compressor, wherein the operation frequency of the compressor increases when the operation frequency of the compressor is lower than a third operation frequency, wherein the operation frequency of the compressor increases after the refrigerant temperature has been maintained lower than a third preset temperature for a preset time period, the third preset temperature being lower than the second preset temperature, wherein the preset temperature is higher than the second preset temperature.

* * * * *